US006612463B2

(12) United States Patent
Hsu

(10) Patent No.: US 6,612,463 B2
(45) Date of Patent: Sep. 2, 2003

(54) TOOTHPICKS DISPENSER

(75) Inventor: Walter Hsu, Yinlin Hsien (TW)

(73) Assignee: Welter's Co., Ltd., Yinlin Hsien (TW)

( * ) Notice: Subject to any disclaimer, the term of this patent is extended or adjusted under 35 U.S.C. 154(b) by 27 days.

(21) Appl. No.: 10/028,818

(22) Filed: Dec. 28, 2001

(65) Prior Publication Data

US 2003/0121931 A1 Jul. 3, 2003

(51) Int. Cl.[7] ..... B23Q 7/12
(52) U.S. Cl. ..... 221/167; 221/255
(58) Field of Search ..... 221/255, 256, 221/163, 167, 171, 191, 237, 238, 268, 190

(56) References Cited

U.S. PATENT DOCUMENTS 4,522,314 A * 6/1985 Nelson ..... 221/190
6,102,249 A * 8/2000 Sjoboen ..... 221/256

* cited by examiner

*Primary Examiner*—Kenneth W. Noland
(74) *Attorney, Agent, or Firm*—Troxell Law Office PLLC

(57) ABSTRACT

A toothpicks dispenser is made up of a top cover, a box embodiment, a bottom board, a holder plate, a pair of pivotal dispensing plane units jointly engaged with the holder plate by a shaft pin and retractably operable by a bias spring. The holder plate and the two symmetric dispensing plane units are integrally housed in the box embodiment which is provided with a rectangular cut at each longitudinal side wall and a flanged top opening with which the top cover is registered. The holder plate of a roof shape is made up of two symmetric oblique planes on which toothpicks are piled up. The two dispensing plane units placed under and in pivotal engagement with the holder plate are provided with a horizontal press wing tab and a vertical toothpick shooting edge on the longitudinal outer side thereof respectively. On a shoulder of each longitudinal side of the box embodiment is disposed a dispensing slot for distribution of an obliquely raised toothpick in each operation after the horizontal press wing of each dispensing plane unit is pressed and released wherein a toothpick on the oblique planes of the holder plate will drop into contact with one of the toothpick shooting edges and be popped out of one of the dispensing slot as the downwardly pressed dispensing plane unit retracts by the bias spring.

5 Claims, 3 Drawing Sheets

TOOTHPICKS DISPENSER

BACKGROUND OF THE INVENTION

The present invention relates to a toothpicks dispenser which is made up of a top cover, a box embodiment, a bottom board, a holder plate, a pair of pivotal dispensing plane units jointly engaged with the holder plate by a shaft pin and retractably operable by a bias spring. The holder plate and the two symmetric dispensing plane units are integrally housed in the box embodiment which is provided with a rectangular cut at each longitudinal side wall and a flanged top opening with which the top cover is registered. The holder plate of a roof shape is made up of two symmetric oblique planes on which toothpicks are piled up. The two dispensing plane units placed under and in pivotal engagement with the holder plate are provided with a horizontal pressing tab and a vertical toothpick shooting edge on the longitudinal outer side thereof respectively. On a shoulder of each longitudinal side of the box embodiment is disposed a dispensing slot for distribution of an obliquely raised toothpick in each operation after the horizontal press wing tab of each dispensing plane unit is pressed and released wherein a toothpick on the oblique planes of the holder plate will drop into contact with one of the toothpick shooting edges and be popped out of one of the dispensing slot as the downwardly pressed dispensing plane unit retracts by the bias spring.

Conventionally, toothpicks are housed in a tubular container 10, as shown in FIG. 1. A top cover 11 in threaded engagement with the container 10 has a through hole 111 and another rotary cap 12 having an oval opening 121 is rotatably registered with the top cover 11. To dispense a toothpick, the cap 12 is rotated to make the oval opening 121 in alignment with the through hole 111 so as to permit the toothpicks inside the container 10 to be taken out by slightly make the container toppled in an up-side-down manner.

There are several disadvantages associated with such a prior art toothpicks dispensing means, given as below:

1. The top cover 11 with the cap 12 is in threaded engagement with the container 10, and the top cover 11 must be removed to refill the container 10 with toothpicks. Such an operation is tedious and inconvenient.
2. To take one toothpick out of the container 10, the cap 12 on the top cover 11 is rotated to make the oval hole 121 of the cap 12 aligned with the through hole 111 of the top cover 11, and then the container 10 is slightly toppled. The toothpicks are easily excessively dispensed more than what desired in number.

SUMMARY OF THE INVENTION

Therefore, the primary object of the present invention is to provide a toothpicks dispenser which adopts a roof-shaped holder plate and two dispensing plane units in pivotal engagement with one another. The toothpicks consecutively accumulated on the holder plate are sequentially dropped into a position when each spring biased dispensing plane unit is pressed down to be dispensed in a slant manner out of one of the slots disposed on a shoulder at each longitudinal side of the box with ease and speed.

Another object of the present invention is to provide a toothpicks dispenser which is equipped with a pair of symmetric dispensing plane units that can be actuated separately or simultaneously to get one or two toothpicks at one time with convenience and speed.

DETAILED DESCRIPTION OF THE PREFERRED EMBODIMENTS

Figure 3:
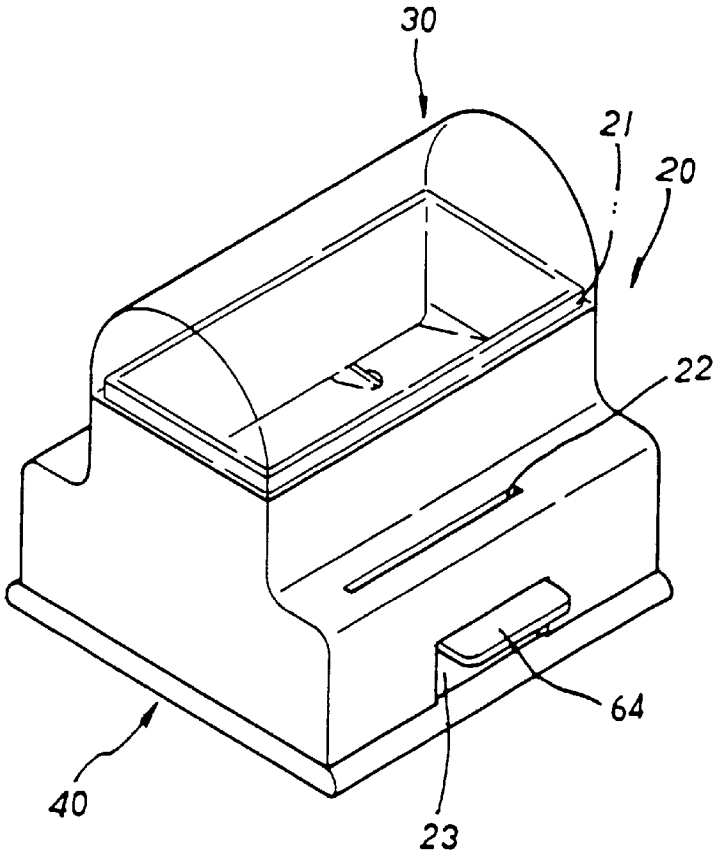
FIG. 3 is a perspective diagram showing the toothpick dispenser of the present invention.
Figure 1:
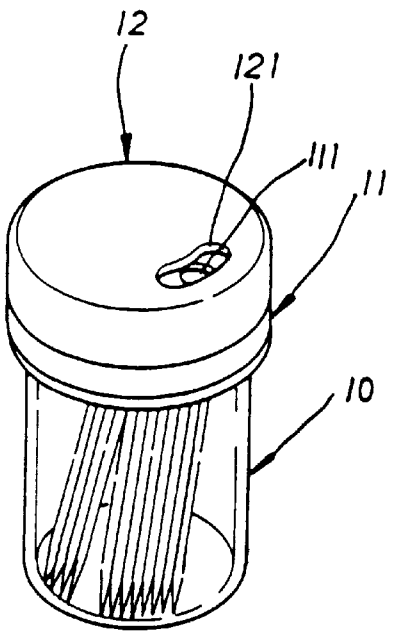
FIG. 1 PRIOR ART
FIG. 1 is a diagram showing a typical prior art toothpick container.
Figure 2:
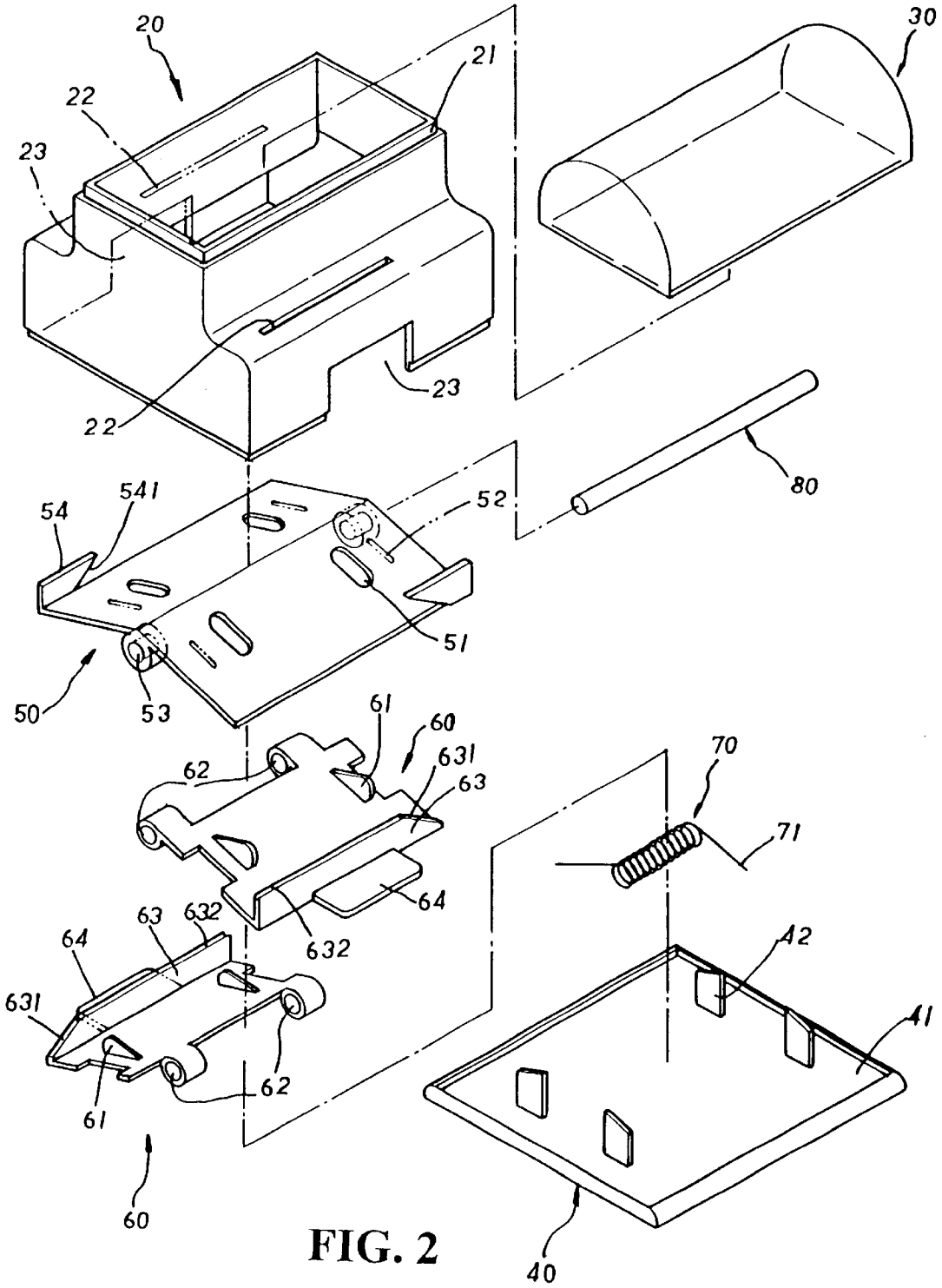
FIG. 2 is a perspective diagram showing the exploded components of the present invention.

Referring to FIG. 2, the toothpicks dispenser of the present invention is comprised of a top cover 30, a box embodiment 20, a bottom board 40, a holder plate 50, a pair of pivotal dispensing plane units 60 jointly engaged with the holder plate 50 by a shaft pin 80 and retractably operable by a bias spring 70.

The box embodiment 20 is made up of a stepwise narrow top section and a wide bottom section that are hollow and in communication with each other. The narrow top section is provided with a rectangular opening having a peripheral flange 21. A shoulder is defined at each side between the top section and the bottom section with an outlet slot 22 defined thereon. On each longitudinal side wall of the wide bottom section is disposed a rectangular cut 23.

The top cover 30 is sized to be in fit registration with the peripheral flange of the top opening of the narrow top section of the box embodiment 20.

The bottom board 40 slightly larger than the bottom of the box embodiment 20 has a recessed closure 41 with four symmetrically disposed vertical positioning plates 42 which have an outwardly oriented slant top edge disposed thereon.

The holder plate 50 made in a roof-shaped form has two slant planes joined at a common raised side. On each oblique plane are disposed two symmetric oval holes 51 corresponding to the positioning plates 42 of the bottom board 40. Next to each oval hole 51 is positioned a retaining slot 52. Under a center line at the common joint side of the two oblique planes is positioned a pivot hole 53 at each end. On each edge of the oblique planes is disposed a vertical support plate 54 having one downward oriented edge 541. The two vertical support plates 54 are located at two opposite corners of the holder plate 50.

The two pivotal dispensing plane units 60, symmetrically structured and placed under each oblique plane of the roof-shaped holder plate 50, are in pivotal engagement with the roof-shaped holder plate 50. Each pivotal dispensing plane unit 60 has a pair of two laterally extended vertical fin-like plates 61 and a pair of hinge holes 62 at one longitudinal side and a vertical support side plate 63 having one upwardly oriented slant edge 631 facing to the downwardly oriented slant edge 541 at the opposite side thereof respectively. A longitudinal groove 632 is defined on a top shooting edge of each vertical support plate 63. A horizontal press wing tab 64 extends from the center of the bottom edge of the vertical support plate 63.

The bias spring 70 has an extended leg 71 at each end. The shaft pin 80 is of a cylindrical rod.

In assembly, the two pivotal dispensing plane units 60 are placed with the hinge holes 62 interlocked under the holder plate 50 and placed in alignment with the pivot holes 53 and shaft pin 80 is led through the hinge holes 62. The bias spring is placed between the hinge holes 62 of the two dispensing plane units 60 with the two extended legs in contact against the underside of each dispensing plane unit

60. The shaft pin 80 is led through one of the pivot holes 53 of the holder plate 50 and the hinge holes 62 of the two dispensing plane units 60 and the bias spring 70 and the other pivot hole 53 at last.

The fin-like plates 61 of each dispensing plane unit 60 align with the oval holes 51 of the holder plate 50 respectively and partially stick out thereof. Each upwardly oriented slant edge 631 of the vertical support plate 63 and the downwardly oriented slant edge 541 of one corresponding vertical support plate 54 are positioned on the same plane and face to each other. Then, so assembled holder plate 50, the two dispensing plant units 60, the bias spring 70 and the shaft pin 80 are fixed to the bottom board 40 by engaging the retaining slots 52 of the holder plate 50 with the respective positioning plates 42 of the bottom board 40. Afterwards, the box embodiment 20 is in locking registration with the bottom board 41 with the flanged bottom of the box embodiment 20 engaged with the recessed closure 41. The outlet slots 22 of the box embodiment 20 align with the vertical support plates 63 respectively and each horizontal press wing tab 64 outwardly extending from each support plate 63 sticks out of the rectangular cut 23 of the box embodiment 20. The top cover 30 is engaged with the peripheral flange 21 of the top opening of the box embodiment to complete the assembly.

Figure 5:
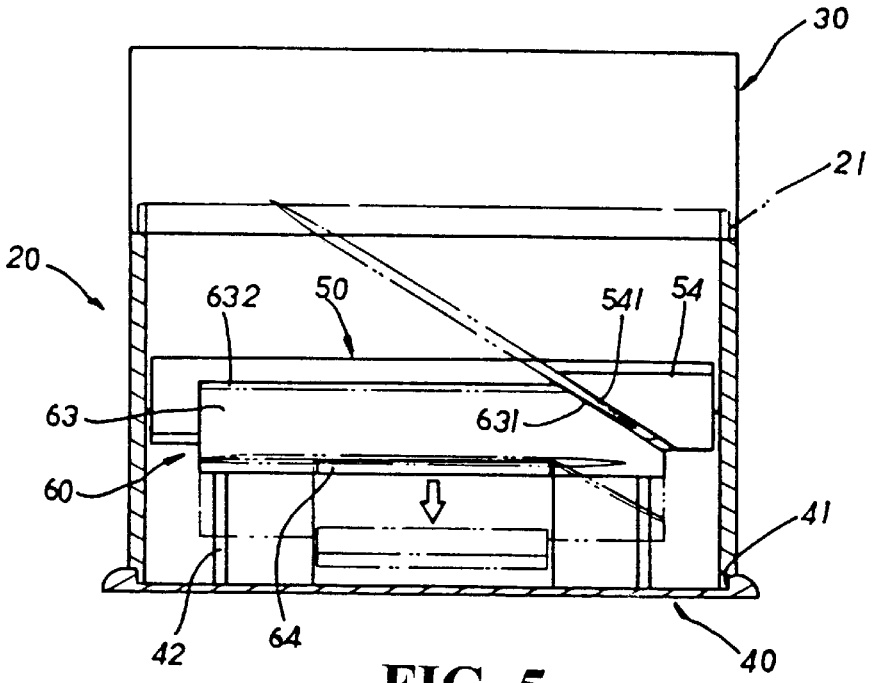
FIG. 5 is a longitudinally sectional diagram showing the dispensing operation of a toothpick of the present invention.
Figure 4:
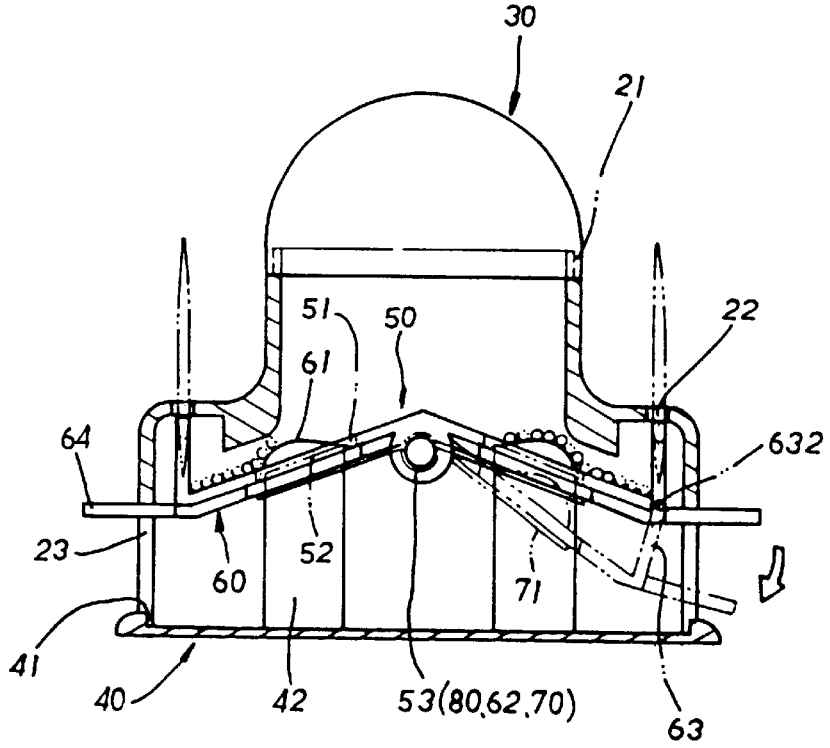
FIG. 4 is a laterally sectional diagram showing the dispensing operation thereof.

Referring to FIGS. 4, 5, as a toothpick is to be dispensed out of the outlet slot 22, either one of the press wing tabs 64 of the dispensing plane units 60 is pushed down to cause the dispensing plane unit 60 pivot downwardly with the fin-like plates 61 disengaging from the oval holes 51 so as to permit toothpicks to move downwardly and one toothpick to drop into the longitudinal groove 632 of the support plate 63 of the dispensing plane unit 60. Then the press wing tab 64 is set free and the extended legs of the bias spring 70 will make the dispensing plane unit resume to its original position. At the same time, the toothpick in the groove 632 of the support plate 63 will be subject to a torque by the upwardly oriented slant edge 631 of the support plate and the downwardly oriented slant edge 541 of the vertical support plate 54, resulting in one end of the toothpick obliquely popping out of the outlet slot 22 of the box embodiment 20.

I claim:

1. A toothpicks dispenser comprising:

a top cover, a box embodiment, a bottom board, a holder plate, a pair of pivotal dispensing plane units jointly engaged with the holder plate by a shaft pin and retractably operable by a bias spring; said holder plate and said two symmetric dispensing plane units are integrally housed in the box embodiment which is provided with a rectangular cut at each longitudinal side wall and a flanged top opening with which said top cover is registered; said holder plate is made up of two symmetric oblique planes on which toothpicks are piled up; said two dispensing plane units placed under and in pivotal engagement with said holder plate are provided with a horizontal press plate and a vertical toothpick shooting edge on the longitudinal outer side thereof respectively; on each longitudinal side of said box embodiment is disposed a dispensing slot for distribution of a slantly raised toothpick in each operation after the horizontal press wing tab of each dispensing plane unit is pressed and released wherein a toothpick on the oblique planes of said holder plate will drop into contact with one of the toothpick shooting edges and be popped out of one of the dispensing slot as the downwardly pressed dispensing plane unit retracts by said bias spring.

2. The toothpicks dispenser as claimed in claim 1 wherein said box embodiment is made up of a narrow top section and a wide bottom section that are in communication with each other for housing toothpicks therein.

3. The toothpicks dispenser as claimed in claim 1 wherein said holder plate is made in a roof-shaped form with two oblique planes commonly joined at a centrally raised side.

4. The toothpicks dispenser as claimed in claim 1 wherein said support holder plate is removably fixed to said bottom board.

5. The toothpicks dispenser as claimed in claim 1 wherein an upwardly oriented slant edge is defined on each said vertical side support plate and a downwardly oriented slant edge is defined on each corresponding vertical support plate are positioned on the same plane and face to each other.

* * * * *